United States Patent [19]

Falk

[11] Patent Number: 4,934,337

[45] Date of Patent: Jun. 19, 1990

[54] RETRACTABLE VENT AND COVER ARRANGEMENT FOR DOWN DRAFT COOKING APPLIANCE

[75] Inventor: Donald G. Falk, Louisville, Ky.

[73] Assignee: General Electric Company, Lousiville, Ky.

[21] Appl. No.: 415,583

[22] Filed: Oct. 2, 1989

[51] Int. Cl.[5] ..... F24C 15/20
[52] U.S. Cl. ..... 126/299 R
[58] Field of Search ..... 126/299 R, 299 D

[56] References Cited

U.S. PATENT DOCUMENTS

| | | | |
|---|---|---|---|
| 2,674,991 | 4/1954 | Schaefer | 126/299 |
| 3,011,492 | 12/1961 | Humbert | 126/299 |
| 3,102,533 | 9/1963 | Jenn et al. | 126/303 |
| 3,409,005 | 11/1968 | Field | 126/300 |
| 3,712,819 | 1/1973 | Field | 99/400 |
| 4,446,849 | 5/1984 | McFarland | 126/299 |
| 4,501,260 | 2/1985 | Grace | 126/299 |

FOREIGN PATENT DOCUMENTS

| | | |
|---|---|---|
| 58-104432 | 6/1983 | Japan . |
| 60-30916 | 2/1985 | Japan . |

*Primary Examiner*—Carroll B. Dority
*Attorney, Agent, or Firm*—H. Neil Houser; Radford M. Reams

[57] ABSTRACT

An improved retractable venting arrangement applicable to cooktops and ranges which have surface heating units supported from a supporting surface such as a countertop. A retractable vent member vertically moves through an opening in the support surface proximate the heating units between a lowered position beneath the support surface and a raised position extending above the surface. A pivotally mounted cover member covers the opening. The cover is opened and closed by the vent member which engages and moves the cover member to its open position as the vent member moves to its raised position. The cover member is held in its open position by the vent member, and returns to its closed position as the vent member returns to its lowered position.

10 Claims, 3 Drawing Sheets

RETRACTABLE VENT AND COVER ARRANGEMENT FOR DOWN DRAFT COOKING APPLIANCE

CROSS-REFERENCE TO RELATED APPLICATIONS

This application relates to commonly assigned co-pending design application Ser. No. 331,572, entitled "Retractable Down Draft Structure for Cooking Appliance" by Falk and Schmitt, filed Mar. 30, 1989, and to commonly assigned co-pending application Ser. No. 331,415, entitled "An Improved Drive Mechanism for Retractable Down Draft Vent" by Cecil, filed Mar. 30, 1989.

BACKGROUND OF THE INVENTION

This invention relates to retractable down draft vent systems for use with range and cooktop appliances.

Down draft ventilation systems for cooking appliances are well known in the art. Typically for electric appliances the vent inlet opening is located at or near the level of the cooking surface. However, with gas cooking appliances it is advantageous to locate the vent inlet opening some distance above the cooking surface so as to minimize the effect of the air drawn into the vent on the gas flames at the surface units. For gas appliances vent systems of the prior art have been provided with retractable vent inlet members which can be raised to an elevated level above the cooking surface when in operation and lowered to the cooking surface level when not in use.

U.S. Pat. No. 4,510,260 to Grace discloses a motor driven retractable down draft vent system. As is typical of the retractable vent systems of the prior art, the top portion of the vent member in Grace is exposed when the vent member is in its lowered position. Thus, the structure which essentially covers the opening in the cooking surface through which the vent member moves is carried on the vent member itself. Though functionally acceptable, such arrangements severely limit the appearance of the appliance. Typically the structure which meets appearance and closure requirements when the vent member is in its retracted position is not particularly aesthetically pleasing when the vent member is in its raised position.

A retractable vent system which gives the appearance designer greater flexibility with respect to the appearance of the vent inlet member would be highly desirable.

It is therefore an object of the present invention to provide a retractable down draft vent system for ranges and cooktops in which the appearance of the retractable vent inlet member in its raised position is independent of the appearance of the cooktop when the vent member is in its lowered position.

It is a further object of the present invention to provide a vent system of the aforementioned type in which the cover for the opening which receives the vent member is separate from the vent member itself.

SUMMARY OF THE INVENTION

The present invention provides an improved retractable venting arrangement applicable to cooktops and ranges which have surface heating units supported from a supporting surface such as a countertop. A retractable vent member is received in an opening in the support surface proximate the heating units. The vent member is adapted for vertical movement through this opening between a lowered position in which the vent member is confined beneath the support surface and a raised position in which the vent member extends above the surface. A cover member is disposed adjacent the opening in the surface for pivotal movement between a closed position in which the cover member substantially closes or covers the opening and an open position exposing the opening. The cover is opened and closed by the vent member which engages and moves the cover member to its open position as the vent member moves to its raised position. The cover member is held in its open position by the vent member, and returns to its closed position as the vent member returns to its lowered position. In a preferred form of the invention, the cover member is biased toward its closed position by suitable means such as a coil spring. That portion of the vent member which initially engages and moves the cover member is contoured to gradually move the cover member between its open and closed positions.

By this arrangement the styling of the vent member may be dictated by the desired appearance in its raised position, with the desired surface appearance of the appliance with the vent member in its lowered position dictating the styling of the cover member.

BRIEF DESCRIPTION OF THE DRAWINGS

While the novel aspects of the invention are set forth with particularity in the appended claims, the invention both as to organization and content will be better understood and appreciated from the following detailed description taken in conjunction with the drawings in which:

DETAILED DESCRIPTION

Figure 1:
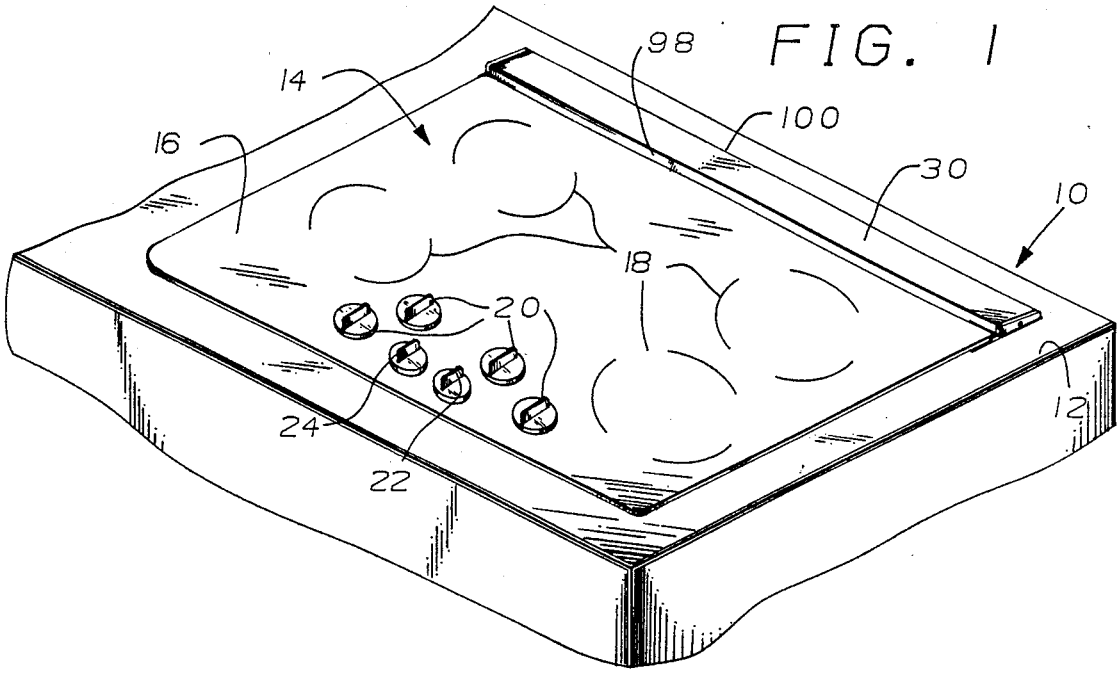
FIG. 1 is a perspective view of a cooktop incorporating an illustrative embodiment of the retractable down draft system of the present invention showing the vent inlet member in its lowered position.
Figure 2:
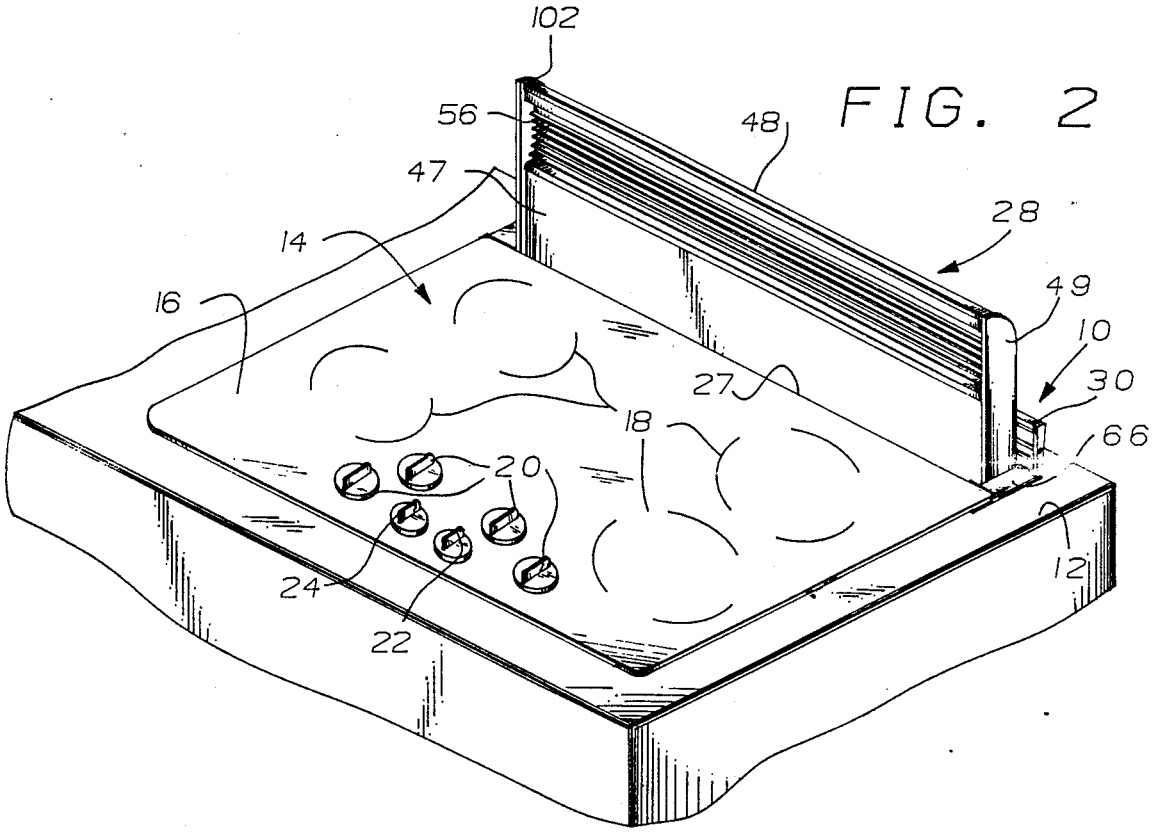
FIG. 2 is a perspective view of the cooktop and vent system of FIG. 1 showing the vent inlet member in its raised position.

Referring initially to FIGS. 1–2, a retractable down draft vent system designated generally 10 is shown disposed in an opening in a supporting surface in the form of countertop 12, along the rear edge of cooktop cooking appliance 14 having a cooking surface 16 supported from countertop 12. In the illustrative embodiment herein described, cooking surface 16 is glass. However, such cooking surfaces are commonly formed of enameled steel, brushed chrome or other materials as well. Cooktop 14 includes a plurality of gas surface heating units illustrated schematically at 18. The vent system herein described is particularly advantageously used with gas burners as the exhaust air flow is sufficiently higher than the surface so as to not interfere with the gas flames. However, the ventilation system is not limited to any particular type of heating arrangement. The surface units could be sheathed electric resistance heaters, radiant heaters, conduction units or solid disk heaters or induction units as well.

Control knobs 20 enable the user to select the desired heating level for each of the surface units 18. Control knob 22 enables the user to control the exhaust blower (not shown) and control knob 24 enables the user to raise and lower the retractable vent.

Figure 3:
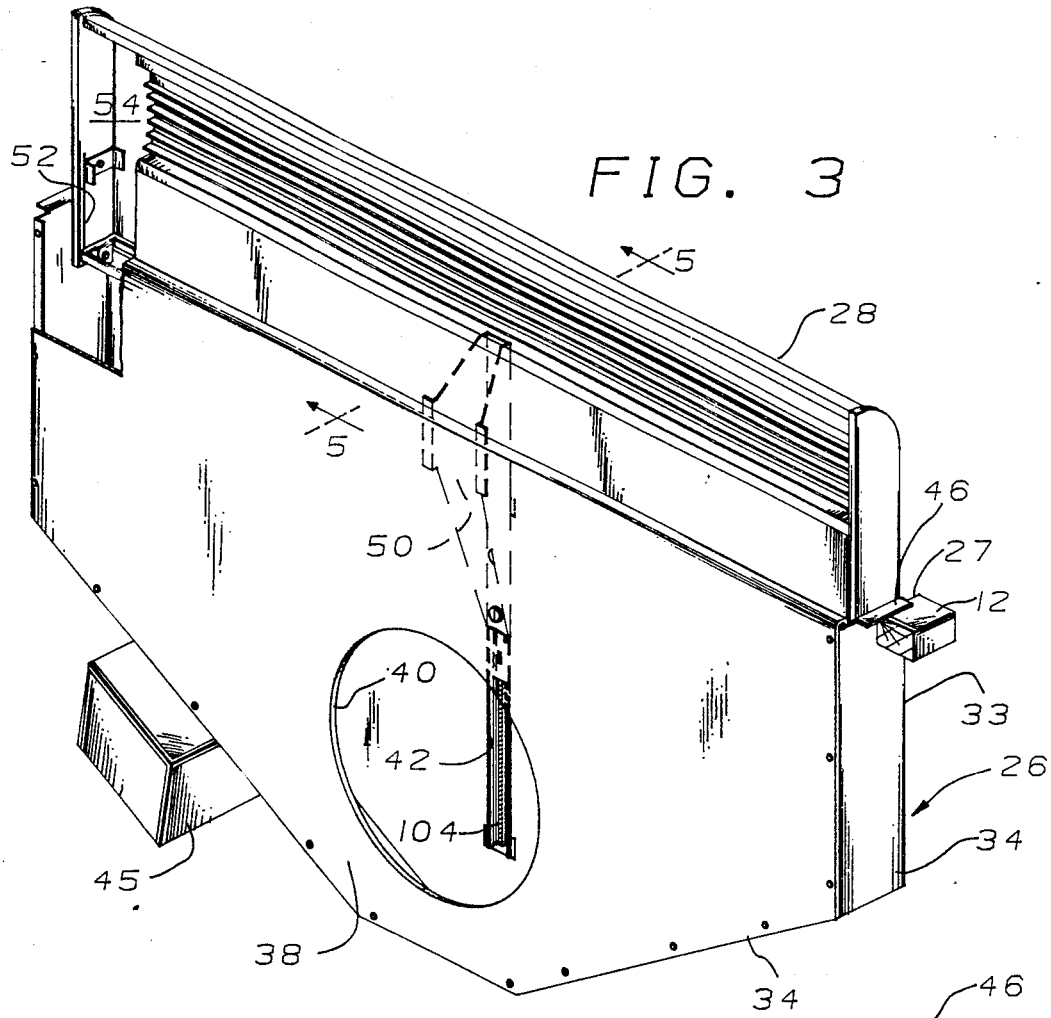
FIG. 3 is a perspective view of the vent system of FIG. 2 with the vent inlet member in its raised position apart from the cooktop with portions broken away to illustrate details thereof.
Figure 4:
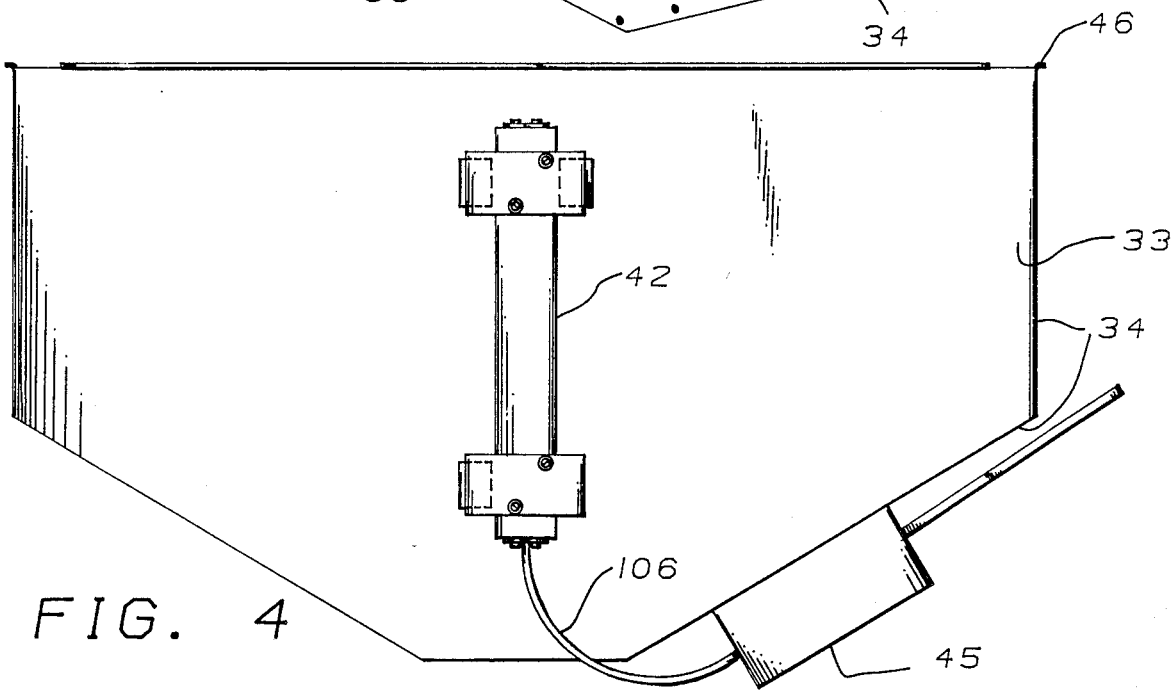
FIG. 4 is a rear plan view of the vent system of FIG. 3 with the vent inlet member in its lowered position.
Figure 6:
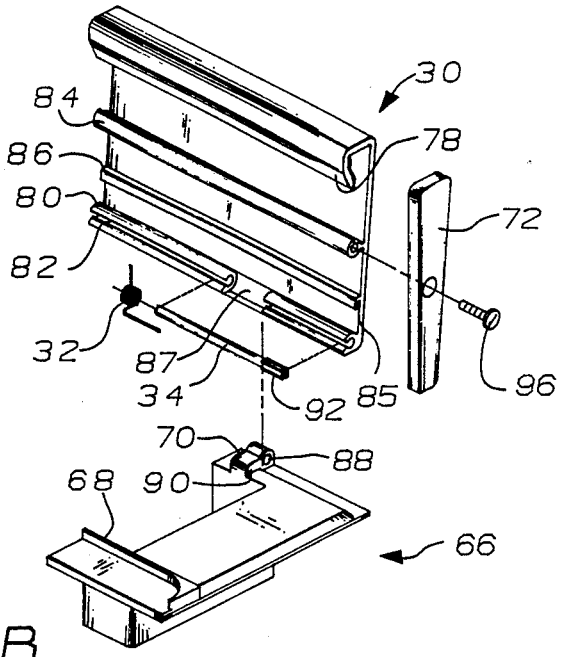
FIG. 6 is a partial exploded perspective view of the cover mounting assembly for the vent system of FIG. 1.
Figure 5A:
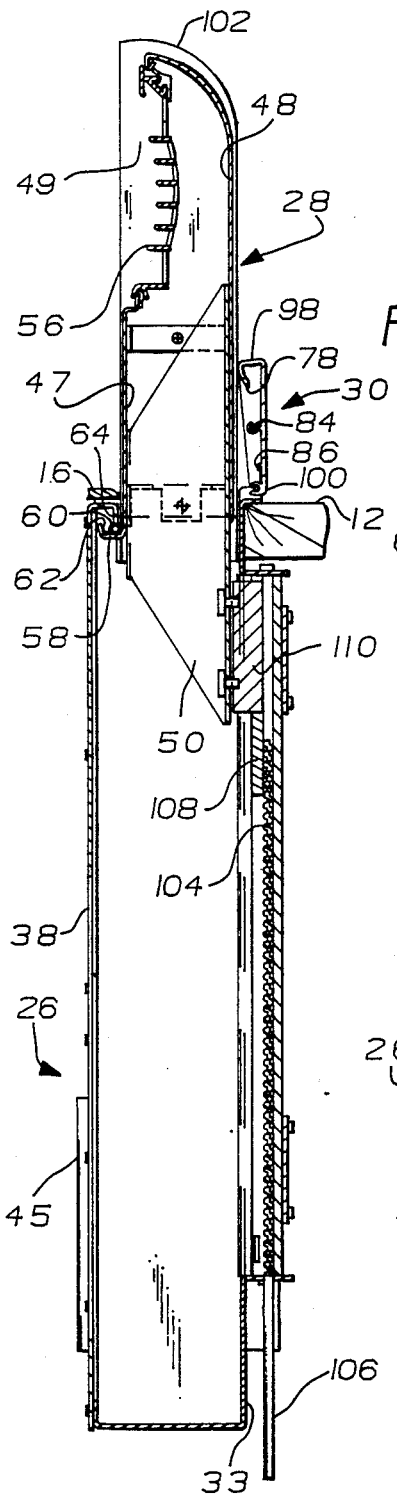
FIGS. 5A–C are sectional side views taken along lines 5—5 of FIG. 2 with portions of the adjacent appliance and cabinetry removed to illustrate details of the vent system showing the vent inlet member in its raised, partially raised and lowered positions respectively.
Figure 5B:
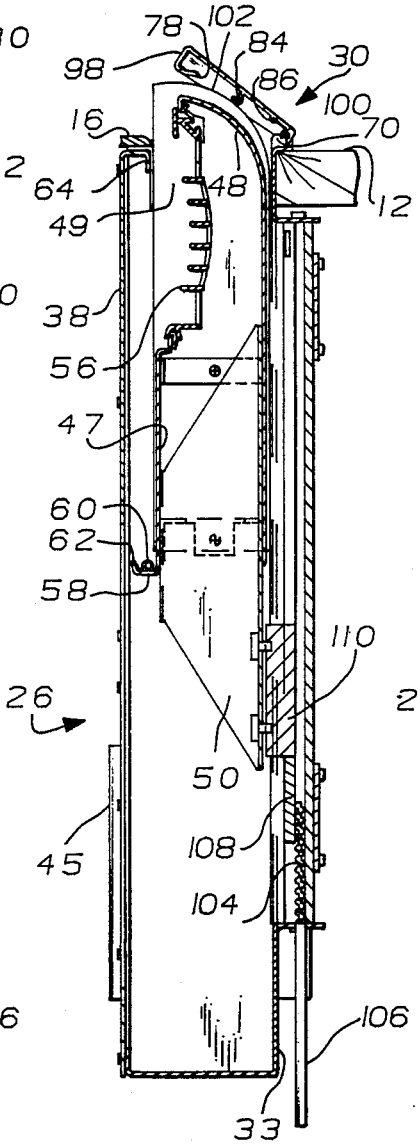
Figure 5C:
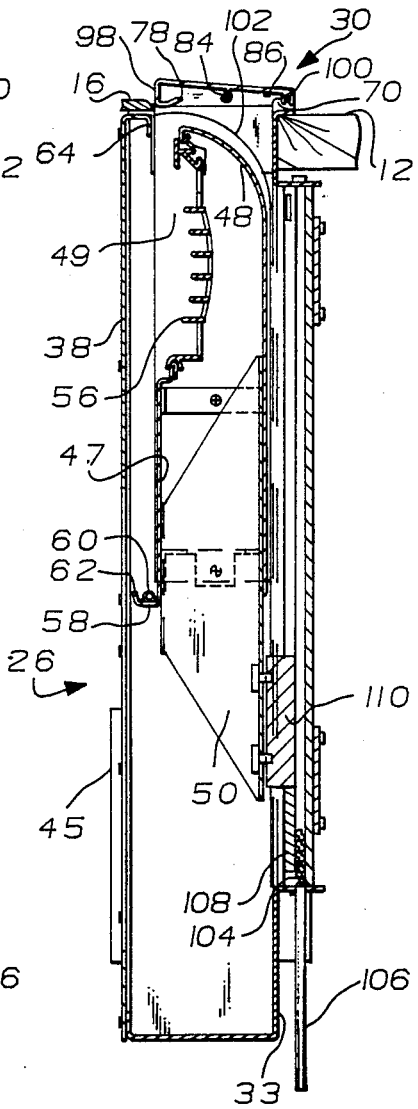

As best seen in FIGS. 3–5, vent system 10 comprises a plenum 26 supported in opening 27 in the countertop 12 along the back or rear edge of cooking surface 16. Plenum 26 extends beneath the countertop with a retractable vent inlet member 28 slidably received in plenum 26 for movement between the lowered position (FIGS. 1 and 5C) recessed to be at or below the cooktop level so as to be non-obtrusive when not in use and a raised position (FIGS. 2 and 5A) elevated with respect to cooking surface 16 to prevent the flow of air drawn into the vent from interfering with the proper surface unit operation. Cover member 30 is mounted adjacent opening 27 in countertop 12 for pivotal movement between an open position (FIGS. 2 and 5A) in which opening 27 is exposed and a closed position (FIGS. 1 and 5C) in which the cover member 30 substantially covers opening 27 to provide a pleasing finished appearance and to prevent spillage from entering the plenum. Cover member 30 is suitably biased to its closed position by bias means preferably in the form of a coil spring 32 wrapped around a hinge pin 34 as best seen in FIG. 6.

The vent member, plenum and drive mechanism described in detail in the aforementioned co-pending U.S. patent application Ser. No. 331,415, hereby incorporated by reference, will be described herein only to the extent necessary to understand the subject invention.

Plenum 26 is essentially hollow sheet metal housing with an open top to receive retractable vent inlet member 28, which in its retracted position is fully received within plenum 26 as best seen in FIG. 5C. A circular aperture 40 is formed in the lower central region of plenum front wall 38 for communication with the exhaust blower structure (not shown), which can be conventional in construction. A vertically extending track 42 for guiding the movement of vent inlet member 28 is mounted in an elongated slot cut out of the plenum rear wall 33. A drive motor for raising and lowering vent inlet member 28 is contained within motor housing 45 mounted to lower side wall 34 of plenum 26. Plenum 26 is supported in opening 27 in countertop 12 by an outwardly turned flange 46 formed at the top edge of each of the plenum side and rear walls 34 and 32 to support plenum 26 from countertop 12.

Vent inlet member 28 comprises sheet metal front and back walls 47 and 48 respectively, joined at the sides by molded plastic end caps 49. Vertically extending channel member 50 provides a sturdy structural member joining front and rear walls 47 and 48 respectively near the center of vent inlet member 28. As best seen in FIG. 3, front wall 47 of vent member 28 fits in a groove 52 formed in the inner face of each end cap 49. Similar grooves are provided in each end cap 49 to receive the lateral edges of rear wall 48.

The rear wall 48 of vent inlet member 28 extends vertically beyond, and curves forwardly toward front wall 47. The gap therebetween defines the inlet opening 54 for vent inlet member 28 which is spanned by grill work 56. Air from the area above cooking surface 16 which is drawn into vent system 10, by an exhaust blower (not shown), preferably mounted proximate opening 40, passes through the inlet opening 54 and down into the interior of plenum 26 and out through aperture 40 to an exhaust duct (not shown) for removal to the outside air. Air filter structure (not shown) may be inserted between the front and back walls of vent inlet member 28.

A forwardly and upwardly bent lip 58 is formed along the lower edge of vent member front wall 47. A gasket member 60 is received in channel 62 formed by lip 58 along the entire length thereof. A corresponding inwardly and downwardly bent lip 64 is formed along the upper edge of plenum front wall member 38. With vent inlet member 28 in its raised position, lip 64 cooperates with lip 58 to compress gasket 60 in channel 62 to provide an essentially air tight seal therebetween to prevent air leakage into the vent system at cooktop level.

A molded plastic appearance trim piece 66 fills the gap at each end of vent member 28 between vent member end caps 49 and the countertop 12. The upper surface of trim piece 66 is contoured to provide an upturned lip or resting edge at 68 which matches the outer edge of cooking surface 16 to locate cooking surface 16 and provide a finished appearance. A portion of the bottom surface of trim piece 66 is contoured to hide flange 46. Trim piece 66 also includes an integrally formed hinge extension 70 for hingedly mounting cover member 30.

As best seen in FIG. 6, the cover assembly for the vent arrangement includes in addition to elongated cover member 30, an end cap 72, hinge pin 34 and coil spring 32 for pivotally mounting each end of cover member 30 to corresponding trim piece 66. Cover member 30 is preferably an elongated extruded aluminum member. A reverse bent flange 78 is formed along one long edge of cover member 30. A channel member 80 of C-shaped lateral cross-section is formed along the opposite edge of cover member 30 defining a channel 82 which extends the length of cover member 30. An integrally formed central reinforcing rib 84 extends the length of cover member 30 to enhance structural rigidity and is configured to provide a screw boss at each end of cover member 30. A second longitudinal channel 85 is formed by the curved longitudinal rib 86.

A portion of channel member 80 is removed near each end defining a notch 87, which receives hinge extension 70 of trim piece 66. Two bores 88 and 90 are formed in hinge extension 70 to receive the hinge pin 34 and one end of coil spring 76 respectively. When assembled, hinge extension 70 of trim piece 66 is positioned in notch 87 with bore 88 coaxially aligned with channel 82. Coil spring 76 is similarly positioned in notch 87 adjacent extension 70 also coaxially aligned with channel 82. Hinge pin 74 is inserted in channel 82 from the proximate open end and extends across notch 86 passing through bore 88 in extension 70 and coil spring 76, into channel 82 on the other side of notch 87. Radial projections 92 formed on the outermost end of hinge pin 74 retain hinge pin 74 in channel 82. One end of coil spring 76 is retained in bore 90 in hinge extension 70, and the other end is captured in channel 85 formed by rib 86, to bias cover member 30 toward its closed position.

A molded plastic end cap 74 encloses each end of cover member 30. Each end cap 72 is secured in place by a screw 96 which screws into central rib 84.

In the preferred embodiment the free edge 98 of cover member 30 opposite hinged edge 100 is raised relative to the surface of cooktop 16 and relative to hinged edge 100 to provide a surface that is uneven relative to the cooking surface to provide an unstable supporting surface thereby reducing the likelihood of having utensils inadvertently set on the cover member.

As best seen in FIGS. 5A–5C, surface 102 of each vent member end cap 49 engages the underside of cover member 30 as the vent member moves from its lowered position (FIG. 5C) to its raised position (FIG. 5A). Surface 102 initially engages flange 78. As cover 30 opens the point of contact shifts from flange 78 to central rib 84 and then back to flange 78. The curved contour of surface 102 is such that cover member 30 opens relatively gradually as the vent member 28 moves from its lowered position. Cover member 30 is held in its open position by engagement with surface 102 of vent member end caps 49, and returns to its closed position as vent member 28 returns to its lowered position beneath cooking surface 16.

One significant advantage of such an arrangement is that since cover 30 is substantially obscured from view when vent member 28 is in its raised position its shape can be selected to meet functional and aesthetic objectives for the appliance when the vent member is in its lowered position. Similarly, vent member 28 can be designed to meet functional and aesthetic objectives for the vent member in its raised position without regard to the surface appearance when in its lowered position.

Movement of the vent inlet 28 is controlled by drive motor enclosed in housing 45 (FIG. 4) which is a reversible electric motor geared to raise and lower the vent 28 at suitable rate of speed. The drive motor is linked to the vent inlet member by a non-rotating helical cable 104 enclosed in cable sheath 106. Cable 104 is fixedly connected to a slider 108 which rides in track 42. Rotational motion of the drive motor is converted to translational motion of cable 104 by a motor driven gear (not shown) which engages the ridges of the helical cable 104. Motor rotation in the first direction moves cable 104 upwardly in the track to raise the vent member and rotation in the opposite direction moves the cable in the opposite direction to lower the vent member. A second slider 110 is attached to the lower portion of channel member 50 of vent member 28. Slider 110 also rides in track 42 and is positioned relative to slider 108 so as to be abuttingly engaged by slider 108. Thus, as slider 108 moves from its lowered to its raised position it drives vent member 28 from its lowered to its raised position. When slider 108 returns to its lowered position the weight of the vent inlet member 28 causes slider 110 to follow slider 108 as it returns to its lowered position returning the vent member 28 to its lowered position. Since there is no positive connection between the sliders 108 and 110, if an obstruction should prevent vent inlet member 28 from returning to its lowered position slider 108 is free to disengage slider 110 and return to its lowered position and the only force exerted on the obstacle is the weight of the vent member itself.

While in accordance with the Patent Statutes, a specific embodiment of the present invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Venting apparatus for a cooking appliance of the type having heating means for surface cooking supported from a surface, with an opening formed in the support surface adjacent the heating means, said venting apparatus comprising:

a retractable vent member adapted for vertical movement through the opening in the support surface between a lowered position beneath the surface and a raised position extending above the surface;

a cover member disposed adjacent the surface opening for pivotal movement between a closed position enclosing the opening and an open position exposing the opening;

said vent member being operative to engage and move said cover member to its open position as said vent member moves to its raised position.

2. The venting apparatus of claim 1 further comprising means for biasing said cover member toward its closed position.

3. The venting apparatus of claim 2 wherein said bias means comprises a coil spring.

4. The venting apparatus of claim 1 wherein that portion of the vent member which initially engages said cover member in moving from its lowered to its raised position is contoured to gradually move said cover member between its open and closed positions.

5. The venting apparatus of claim 4 further comprising motor means for controlling the movement of said vent member.

6. Venting apparatus for a cooking appliance of the type including a cooktop cooking surface mounted on a support surface and an opening in the support surface proximate the cooktop cooking surface, said venting apparatus comprising:

an air plenum supported in the opening in the support surface having an opening formed in the top thereof;

a retractable vent member having an air inlet opening formed therein, said vent member being slidably received in said plenum for vertical movement between a lowered position in which said vent member is disposed beneath the support surface, and a raised position in which said vent member projects through said plenum opening and said inlet opening is positioned above the cooking surface;

a cover member mounted proximate the opening in the support surface for pivotal movement between a closed position covering said plenum opening and a raised position exposing said plenum opening;

said vent member being operative to engage and move said cover member to its open position in moving from its lowered to its raised position.

7. The venting apparatus of claim 6 further comprising bias means for biasing said cover member toward its closed position.

8. The venting apparatus of claim 6 further comprising motor means for controlling movement of said vent member.

9. The venting apparatus of claim 6 wherein said vent member includes a cover engaging surface and said cover member tracks said engaging surface as said vent member moves from its lowered position to its raised position, the contour of said engaging surface permitting said vent member to gradually move said cover member to its open position as said vent member moves to its raised position.

10. The venting apparatus of claim 6 wherein at least a portion of said cover member when in its closed position projects slightly above the cooktop level of the cooking surface.

* * * * *